United States Patent [19]

Matunaga et al.

[11] Patent Number: 4,939,811

[45] Date of Patent: Jul. 10, 1990

[54] FLOOR POLISHER WITH A DUST COLLECTING DEVICE

[75] Inventors: Akira Matunaga; Hideo Inoue; Ken Ikezawa; Tetu Arai, all of Shizuoka, Japan

[73] Assignee: Amano Corporation, Yokohama, Japan

[21] Appl. No.: 284,059

[22] Filed: Dec. 12, 1988

[30] Foreign Application Priority Data

Dec. 14, 1987 [JP] Japan ..... 62-315663

[51] Int. Cl.[5] ..... A47L 11/20

[52] U.S. Cl. ..... 15/385; 15/349

[58] Field of Search ..... 15/385, 349

[56] References Cited

U.S. PATENT DOCUMENTS

| | | | |
|---|---|---|---|
| 2,415,372 | 2/1947 | Salt et al. | 15/385 X |
| 4,701,976 | 10/1987 | Palmer et al. | 15/385 |
| 4,715,087 | 12/1987 | Todd et al. | 15/385 |
| 4,731,895 | 3/1988 | Zack et al. | 15/385 |
| 4,731,956 | 3/1988 | Wood | 15/385 |
| 4,805,258 | 4/1989 | Sitarski et al. | 15/385 |

*Primary Examiner*—Chris K. Moore

*Attorney, Agent, or Firm*—Wenderoth, Lind & Ponack

[57] ABSTRACT

A floor polisher with a dust collecting device has a buffing pad which is rotated at a high speed by a motor, a circular cover member and a skirt for covering an upper surface of the buffing pad, and a dust collecting device for exerting a collecting function thereof on an internal space surrounded by the cover member and the skirt. The floor polisher is characterized in that the cover member and the skirt are partly extended on a tangential line to form a guide chamber for a dust-containing air current, that the guide chamber is provided at an inlet port thereof with a guide wall opposite inner wall surfaces of the cover member and the skirt extended on the tangential line and an inclined plate which is inclined toward a floor, and that the guide chamber is provided at the outer end thereof with an outlet port communicating with the dust collecting device.

1 Claim, 4 Drawing Sheets

FLOOR POLISHER WITH A DUST COLLECTING DEVICE

BACKGROUND OF THE INVENTION

1. Field of the Invention

This invention is used in the technical field of a floor polisher, a buffing machine or a burnisher (hereinafter simply referred to as "floor polisher") for effectively performing a floor buffing or polishing as the last stage of a floor dry care system and more particularly to a floor polisher equipped with a device for collecting various dusts which are generated when a buffing pad is rotated at a high speed for buffing a floor.

2. Brief Description of the Prior Art

In general, in order to polish up a floor using a floor polisher, a floor polisher of the type as shown in FIG. 5 is used after various waxes are applied to a floor.

That is, FIG. 5 illustrates a sectional view of an important portion of a conventional floor polisher. In the figure, reference numeral 1 denotes a motor, 2 denotes a hub directly connected to the motor 1, 3 denotes a pad table mounted on the hub 2, and 4 denotes a buffing pad mounted on the bottom surface of the pad table 3 by a center lock 5. Similarly, 3*a* denotes a coarse brush-like fiber bonded to the floor surface of the pad table 3. The burnishing pad 4 is made of a nonwoven fabric formed with polishing materials mixed and bonded together and is centered by the center lock 5. Such burnishing pad 4 is cut into the fiber 3*a* and mounted on the bottom of pad table 3. The burnishing pad 4 is rotated by the motor 1 at a high speed such as, for example, $\phi$510 mm, 2,000 rpm and 52 m/sec of a peripheral speed.

However, when the above-described conventional floor polisher is used, various dusts such as wax powders, polishing materials and fiber odds of the pad, cotton odds, hairs, or earth and sand (hereinafter simply referred to as "dust") remaining on the floor are scattered around by a circulation air current caused by the buffing pad 4 which rotates at a high speed and make dirty the indoor environment, merchandise and the like, or equipment and the like.

As a counter-measure, the buffing pad 4 is covered at the upper surface side thereof with a cover member 6, a skirt 7, etc. as shown in FIG. 5 in order to prevent the scattering of the various dusts. However, this method is not effective when a floor F has an uneven surface because gaps are formed between the floor and the skirt and dusts are scattered outside through the gaps to make the floor therearound dirty.

That is, an air current generated by the buffing pad 4 rotating at a high speed circulates at a high speed through an internal space 8 between the buffing pad 4 and the skirt 7 of FIG. 5 in the direction as shown by the broken-line arrows X in FIG. 6. Since there are two speed components, i.e., one is in the circumferential direction and the other in the radius direction, the circulating speed is slowed down to some extent. However, if gaps are formed between the floor F and the skirt 7 when the cover member 6 and the motor 1 are completely sealed, a dust-containing air current is jetted out through the gaps as shown by big arrows A and the same amount of atomsphere as that of the jetted air current is intaken into the space 8 through other gaps as shown by big arrows B.

On the other hand, if gaps are formed between the cover member 6 and the motor 1, atmosphere is intaken through the gaps, and a dust-containing air current is vigorously jetted out of the gaps between the floor F and the skirt 7. Therefore, the method for simply covering the upper surface side of the buffing pad 4 with the cover member 6 and the skirt 7 in the manner as shown in FIGS. 5 and 6 is not effective for completely preventing the scattering of dusts.

In order to overcome the above-mentioned problem, there have been developed an improved floor polishers. One such example is disclosed by Japanese patent application early laid-open publication No. Sho 62-155823, in which a dust containing air current is guided to a dust collecting device by using a circulation air current generated by a buffing pad rotating at a high speed and a vacuum shroud device but without using an independent vacuum fan. Another such example is disclosed likewise in Japanese patent application early laid-open publication No. Sho 62-16133, in which a vacuum fan adapted to positively perform an intaking of atmosphere and a discharging of a dust-containing air current is disposed within a cover member.

The first-mentioned conventional floor polisher, as shown in FIG. 7, has an air inlet port 6*a* formed between a pad rotating hub 2 and a cover member 6, and a seal member 7*a* disposed at a lower edge of a skirt 7 and for intimately attaching to a floor F. When a buffing pad 4 is rotated by the hub 2, air is intaken through the air inlet port 6*a* and circulated around the buffing pad 4. A dust-containing air current is fed into a dust collecting device (not shown) side such as, for example, a dust collecting bag together with the circulating air current through an outlet port 9 formed on a cover member 6.

On the other hand, the second-mentioned floor polisher, as shown in FIG. 8, has an air inlet port 6*a* opened up at an upper surface of a cover member 6, a fin 2*a* serving as a vacuum fan formed on a hub 2, and an outlet port 9 or 10 formed at one end of the cover member 6 and communicating with the same dust collecting device (not shown) as mentioned, a dust-containing air current is positively guided to the outlet port 9 side by means of the rotation of the fin 2*a*.

However, since the floor F has a lot of irregularities, it is practically impossible to completely intimately contact the skirt 7 with the floor F. Even if the seal member 7*a* is provided on the skirt 7 as in the first-mentioned floor polisher, gaps are formed at the irregular portion of the floor. Therefore, in the first-mentioned conventional floor polisher, air intaken from the air inlet port 6*a* is vigorously jetted out of the gaps to scatter dusts. Furthermore, there is as a problem as that the energy of a circulating air current along, which is generated by means of the rotation of the buffing pad 4, is not sufficient to feed a dust-containing air to the dust collecting device side so that the dust is collected therein. Therefore, the outlet port 9 is required to have a sealed box type dust collector provided therein with a structually strong filter so that dust-containing air is positively intaken by a powerful fan or a blower.

On the other hand, in the second-mentioned floor polisher, atmosphere intaken by the fin 2*a* through the inlet port 6*a* raises the internal pressure of the internal space 8. Therefore, if gaps are formed between the skirt 7 and the floor F, a dust-containing air is more vigorously jetted out of the gaps and the dust-containing current is not sufficiently flowed to the outlet port 9 side. Therefore, even in this type of floor polisher, in order to prevent the jetting of dust from the skirt 7, it is required that the outlet port 9 or 10 be provided with the same dust collecting device as that of the first-mentioned floor polisher so that the dust-containing air is intaken by a powerful fan or a blower.

There has also been proposed a floor polisher which is formed by removing the inlet port 6a from the second mentioned conventional floor polisher of FIG. 8, gaps between a cover member 6 and a motor 1 being sealed so that an attracting force of a dust collecting device is acted on an outlet port 9 or 10. However, even in this floor polisher, in order to prevent the jetting of dust through the gaps of a skirt 7, it is required that a powerful attracting force by means of a fan or a blower act on the outlet port 9 or 10.

However, in order to rotate the buffing pad 4 at a high speed such as, for example, $\phi$510 mm, 2,000 rpm, the pad motor 1 requires an output power of 1.1 KW. In order to prevent the jet-out of dust through the gaps of the skirt at that time, it is required that an attracting force act on the outlet port 9 or 10 with an output power of a motor of 0.75 KW. or more. In this case, the total of the output power required becomes approximately 1.9 KW. This amount is unobtainable from an ordinary plug socket (usually 15A and possibly 20A) at, for example, 100 V and thus the device is impractical as a home appliance or the like. Even in the case of a battery type power supply, such a drawback still exists because the weight and cost are increased as the capacity increases.

The present invention has been accomplished in order to overcome the above-described problems inherent in the prior art.

SUMMARY OF THE INVENTION

It is therefore an object of the present invention to provide a floor polisher with a dust collecting device which, on the assumption that gaps are necessarily present between a skirt and a floor surface, is capable of effectively preventing the jet-out of dust from the skirt portion with a least possible attracting force and which can be operated with a small motor output power (for example, approximately 1.2 KW) able to be obtained from a commercial electric power source of 100 V.

In order to solve the above-mentioned technical problems, means adopted in the present invention are as follows.

(1) In a floor polisher with a dust collecting device comprising a buffing pad which is rotated at a high speed by a motor, a cover member and a skirt of a circular shape for covering an upper surface of the buffing pad, and a dust collecting device for exerting an attracting force on an internal space surrounded by the cover member and the skirt, the cover member and the skirt are partly extended on a tangent line to form a guide chamber for a dust-containing air current.

(2) The guide chamber is provided at an inlet port thereof with a guide wall opposite inner wall surfaces of said cover member and said skirt extended on the tangent line.

(3) Furthermore, the guide chamber is provided at the inlet port thereof with an inclined plate which is inclined toward the floor.

(4) Furthermore, the guide chamber is provided at a front end thereof with an outlet port communicating with the dust collecting device.

The above-described means function as follows.

1. The element of the above-mentioned (1) can make it possible that a large portion of a dust-containing air current which circulates within an internal space surrounded by the cover member and the skirt in accordance with high-speed rotation of the buffing pad is successively fed into the guide chamber extended on a tangent line along the inner walls of the cover member and the skirt during circulation.
2. The element of the above-mentioned (2) can make it possible that a dust-containing air current circulating along the inner walls together with the buffing pad is guided into the guide chamber by the guide wall in cooperation with the inertia energy thereof, and such introduced dust-containing air current is prevented from circulating around the buffing pad as a circulation current again.
3. The element of the above-mentioned (3) can make it possible that a dust-containing air current circulating near a floor in accordance with the rotation of the buffing pad is guided as if spooned upward by the inclined plate and effectively fed into the guide chamber.
4. The element of the above-mentioned (4) can make it possible that a dust-containing air current fed into the guide chamber guided by the guide wall and the inclined plate acts with the attracting force of the dust collecting device thereby to more effectively collect dust through the outlet port, and as a result, the pressure in the internal space surrounded by the cover member and the skirt is lowered and in case gaps are generated between the skirt and the floor, outside air is intaken through the gaps, and therefore, the dust-containing air current is prevented from being jetted out of the gaps between the skirt and the floor, thereby to solve the problem of generation of environmental pollution due to the jetted dust. Moreover, since no energy for positively attracting the dust-containing air current circulating at a high speed is required, the dust-containing air current can effectively be attracted by a dust collecting device using the smallest possible motor output power, and thereby the floor polisher having a dust collecting function can be operated even by a commercial electric power source of 100 V without fail and in addition, in the case of a battery type power supply, its capacity can be minimized.

As described in the above, the above-described technical problems can be solved by the above-described means, thereby to solve the technical problems involved in the prior art.

BRIEF DESCRIPTION OF THE DRAWINGS

The above objects and still further objects of the present invention will immediately become apparent to those skilled in the art after consideration of the following preferred embodiments of the present invention shown in the accompanying drawings and which are provided by way of example and not by way of limitation wherein.

DETAILED DESCRIPTION OF THE PREFERRED EMBODIMENTS

Several preferred embodiments of a floor polisher with a dust collecting device according to the present invention will be described in detail with reference to FIGS. 1 through 4.

Figure 1:
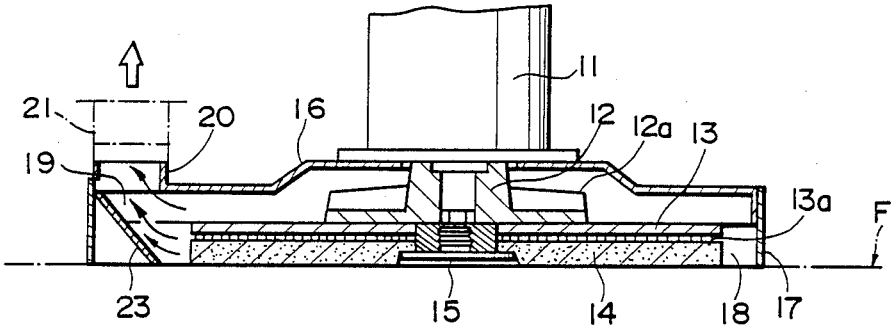
FIG. 1 is a regular diametrical sectional view of a floor polisher with a dust collecting device according to a first embodiment of the present invention.
Figure 2:
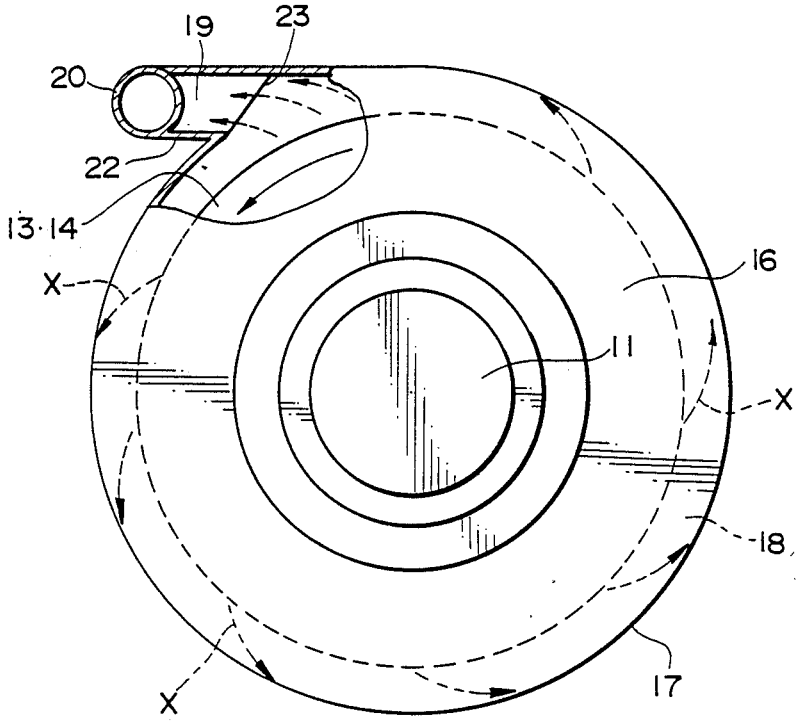
FIG. 2 is a partly cut-away plan view thereof.

FIGS. 1 and 2 show a first embodiment of the present invention. In the figures, reference numeral 11 denotes a motor, 12 denotes a hub directly connected with the motor 11, 12*a* denotes a reinforcement rib integral with the hub 12, 13 denotes a pad supporting disk or table mounted on the hub 12, and 13*a* denotes a fiber attached to the under side of the pad table 13 and adapted to hold a pad. As the fiber 13*a*, a coarse brush type fiber is used. 14 denotes a buffing pad of a non-woven fiber which is formed by mixing and bonding polishing material. The pad 14 is centered by a center lock 15 and mounted on the pad table 13 with its upper surface cut into the holding fiber 13*a*.

Reference numeral 16 denotes a cover member for covering the upper surface side of the buffing pad 14. The cover member 16 having a circular shape as a whole is attached in air tight engagement to the motor 11 and is provided with a skirt 17 attached to a peripheral depending edge flange thereof and adapted to prevent the jet-out of dust. The buffing pad 14 is rotated by the motor 11 at a high speed such as, for example, $\phi$510 mm, 2,000 rpm, and 52 m/sec of peripheral speed within a space 18 surrounded by the cover member 16 and the skirt 17.

Next, reference numeral 19 denotes a guide chamber formed by partly extending the cover member 16 and the skirt 17 in a tangential direction to the skirt 17, and 20 denotes an outlet port formed at an upper surface of an outer end portion of the guide chamber 19. The outlet port 20 is connected with a suction hose 21 of a dust collector (not shown).

Similarly, reference numerals 22 and 22*a* are guide walls extending from the skirt 17 in a tangential direction to define the opposite sides of guide chamber 19. A dust-containing air current circulating within the internal space 18 in the directions as shown by the arrows X by the buffing pad 14 rotating counterclockwise at a high speed in the figure hits the guide wall 22*a* by a force of inertia during circulation and is then guided in the tangential direction. At the same time, since the dust-containing air current is prevented from returning to the circulation air current again, it is effectively guided through the guide chamber 19 to the outlet port 20. 23 denotes an inclined plate disposed at the bottom portion of the inlet of the guide chamber 19. The inclined plate 23 together with the rotating buffing pad 14 can direct upward the dust-containing air current during the circulation near the floor F and guide the same into the guide chamber 19 and the outlet port 20.

Therefore, according to the floor polisher according to the first embodiment of the present invention, since the dust-containing air current circulating within the internal space 18 together with the buffing pad 14 is guided by the guide walls 22 and 22*a* the inclined plate 23 during circulation and flows into the guide chamber 19 and the outlet port 20 by the force of inertia, the dust collector can smoothly and effectively collect or intake such dust-containing air current from the outlet port 20 with a comparatively small motor output power. Moreover, since the pressure in the internal space 18 is lowered by the effective dust collector, dust is prevented from jetting out of the gaps between the skirt 17 and the floor F. At the same time, since an intake effect acts on the outside air through the gaps between the skirt 17 and the floor F, dust outside the cover member 16 can be drawn in thereby to clean the floor F nearby.

Figure 3:
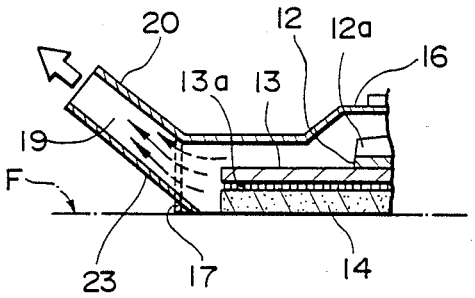
FIG. 3 is a partial diametrical sectional view showing a second embodiment of the present invention.

FIG. 3 shows a second embodiment of the present invention. In the second embodiment, in order to further enhance the drawing in of a dust-containing air current by a dust collector, an outlet port 20 is disposed at the same angle as the inclined plate 23. Since the remaining construction is the same as that of the first embodiment shown in FIGS. 1 and 2, a detailed description will be omitted.

Figure 4:
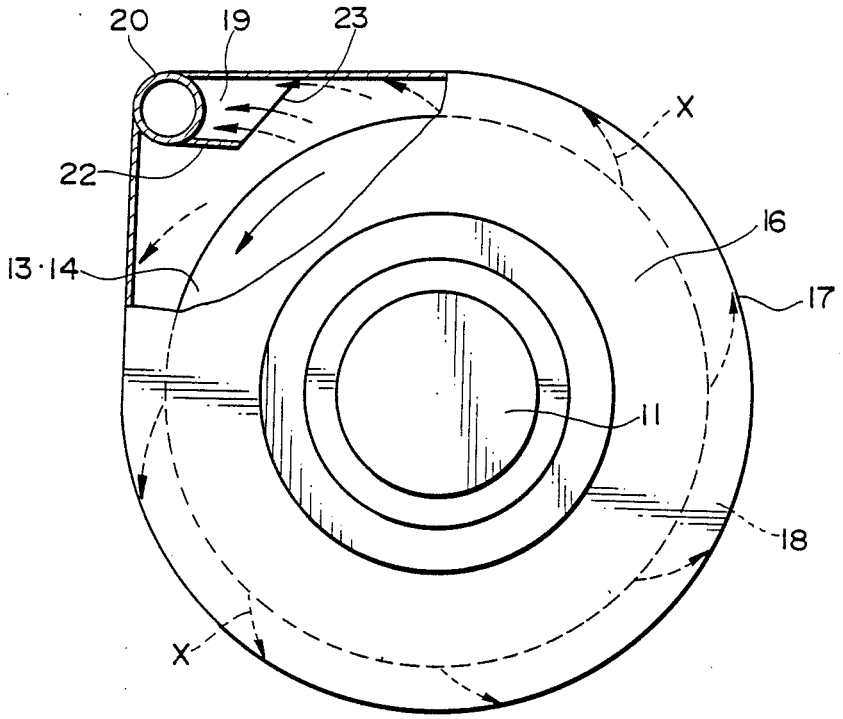
FIG. 4 is likewise a partly cut-away plan view of a third embodiment of the present invention.
Figure 5:
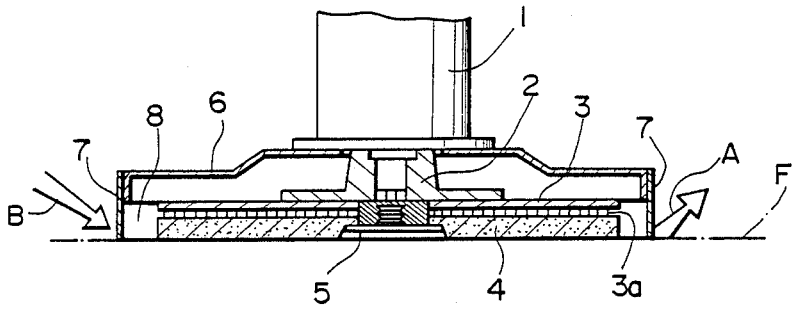
FIG. 5 PRIOR ART
FIG. 5 is a regular sectional view of a prior art apparatus.
Figure 6:
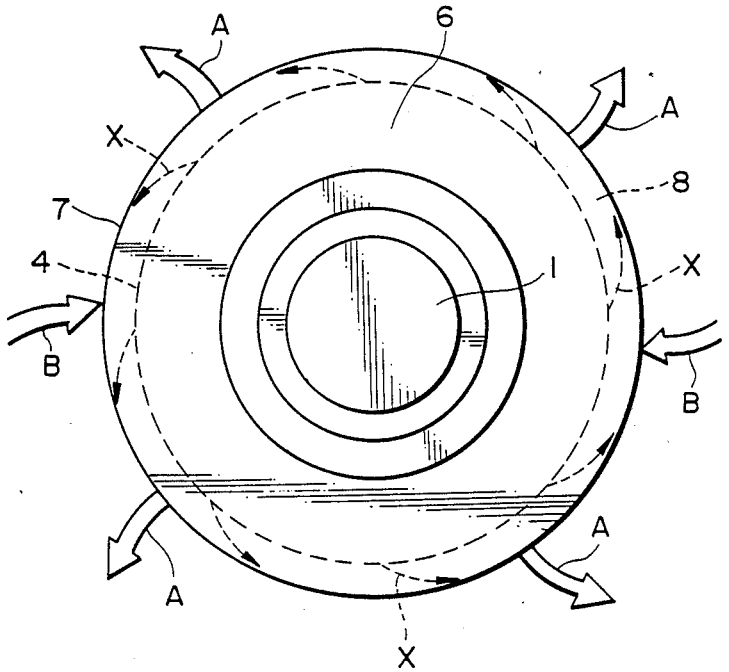
FIG. 6 PRIOR ART
FIG. 6 is a plan view thereof.
Figure 7:
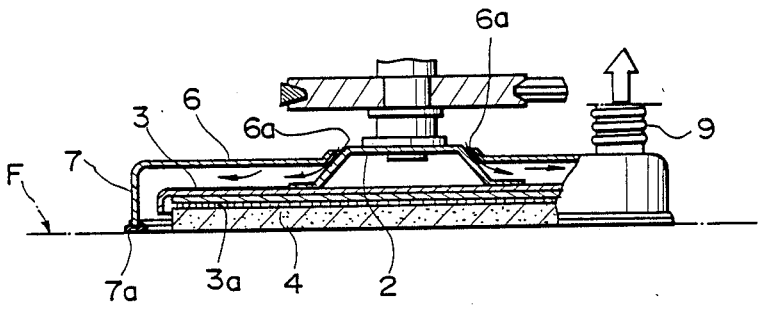
FIG. 7 PRIOR ART
FIGS. 7 and 8 are likewise sectional views of still another prior art apparatus.
Figure 8:
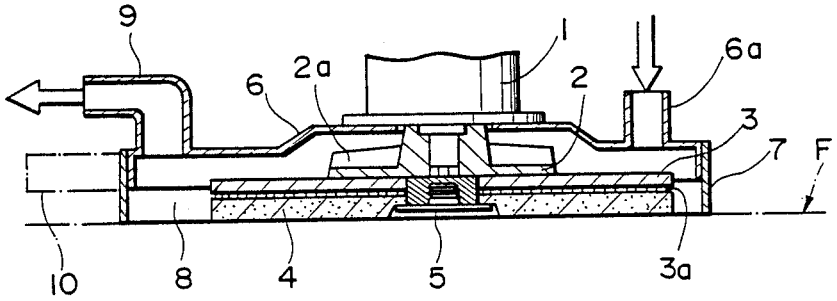
FIG. 8 PRIOR ART

FIG. 4 shows a third embodiment of the present invention. In the third embodiment, a cover member 16 and a skirt 17 are partly extended in the tangential direction toward an outlet port 20 of a guide chamber 19 from both sides thereof. Since the remaining construction is the same as that of the first embodiment, the detailed description will be omitted.

As is apparent from the foregoing description of a floor polisher with a dust collecting device according to the present invention, a dust-containing air current circulating within an internal space surrounded by a cover member and a skirt due to a buffing pad rotating at a high speed is guided by guide walls and an inclined plate and successively flows into a guide chamber and an outlet port disposed in the tangential direction by the force of its own inertia, and is then effectively collected or intaken by a dust collector through the outlet port. Accordingly, even if gaps are present between the skirt and the floor, no dust will be jetted out of the gaps. Therefore, there can be prevented the occurrence of environmental pollution and a worker's health can be protected. Becausde of the foregoing reasons, the floor polisher of the present invention can be safely and sanitarily used in hospitals. Moreover, since the collecting function of the dust collector and the circulating air current acts outside the skirt through gaps between the skirt and the floor, the cleaning effect is further increased. For example, dust caused by the polishing work can be attracted on the spot and cleaning work in the following process can be avoided. Furthermore, a dust cleaning operation prior to a polishing work of the floor can also be omitted.

Still further, in the present invention, since the attraction of a dust-containing air current by a dust collector can be performed with a comparatively small motor output power (approximately 0.1 KW), the operation of the floor polisher can be performed with approximately 1.2 KW at the most even if the output power of the pad motor is included. Therefore, the floor polisher of the present invention can be operated using a commercial electric power source of 100 V. In the event a battery type power supply is employed, there can be obtained various economical advantages such as extension of a driving time, light weight, reduced cost, etc. In addition, the floor polisher with a dust collecting device of the present invention is simple in structure and easy to operate. Thus, the floor polisher with a dust collecting device of the present invention is indeed a greatly improved instrument.

While particular embodiments of this invention have been shown in the drawings and described above, it will be apparent that many modifications and alternations may be made. In consideration thereof, it should be understood that preferred embodiments of this invention disclosed herein are intended to be illustrative only and not intended to limit the scope of the invention.

What is claimed is:

1. A floor polisher with a dust collecting device, comprising:

a disc-shaped buffing pad rotatable about a center axis;

a motor connected to said buffing pad for rotating said buffing pad at a high speed;

a circular cover member spaced above and covering the upper surface of said buffing pad;

a skirt depending from the peripheral edge of said cover member to the level of the bottom of said buffing pad and circumferentially encircling a space below said cover member and within said skirt and having a dust discharging opening therein;

a dust collecting device for exerting a suction on said space; and a guide chamber extending outwardly of said skirt from said dust discharging opening and having a radially outer wall extending from said skirt on a line tangent to said skirt, a top wall extending from said cover, a radially inner wall spaced inwardly from and parallel to said outer wall, and an inclined bottom wall inclined upwardly from the position of the lower edge of said skirt at said dust discharging opening and in a direction parallel with said inner and outer walls, said guide chamber having an outlet port at the end remote from said dust discharging opening and communicating with said dust collecting device.

* * * * *